US008888310B2

(12) United States Patent
Dayan

(10) Patent No.: US 8,888,310 B2
(45) Date of Patent: Nov. 18, 2014

(54) FLOATING ILLUMINATION DEVICE

(75) Inventor: Mervin A. Dayan, Oakhurst, NJ (US)

(73) Assignee: Intellectual Solutions, Inc.

( * ) Notice: Subject to any disclaimer, the term of this patent is extended or adjusted under 35 U.S.C. 154(b) by 279 days.

(21) Appl. No.: 13/572,335

(22) Filed: Aug. 10, 2012

(65) Prior Publication Data

US 2014/0043799 A1 Feb. 13, 2014

(51) Int. Cl.

| | |
|---|---|
| ***F21V 31/00*** | (2006.01) |
| ***F21V 15/00*** | (2006.01) |
| ***F21L 4/00*** | (2006.01) |
| ***F21S 9/02*** | (2006.01) |
| *F21W 121/00* | (2006.01) |
| *F21Y 101/02* | (2006.01) |

(52) U.S. Cl.

CPC ..... *F21V 31/005* (2013.01); *F21V 15/00* (2013.01); *F21L 11/00* (2013.01); *F21S 9/02* (2013.01); *F21W 2121/00* (2013.01); *F21Y 2101/02* (2013.01)

USPC ..... 362/158; 362/311.06; 362/122

(58) Field of Classification Search

CPC ..... F21V 15/00; F21V 31/005; F21L 11/00

USPC ..... 362/158, 296.01, 298, 311.06, 122

See application file for complete search history.

(56) References Cited

U.S. PATENT DOCUMENTS

| | | | | |
|---|---|---|---|---|
| D37,243 | S | 11/1904 | Helmschmied | |
| 2,234,903 | A | 3/1941 | Muench | |
| D130,737 | S | 12/1941 | Balk | |
| 2,316,342 | A | 4/1943 | Krieg | |
| D186,082 | S | 9/1959 | Fischett | |
| 3,944,138 | A | 3/1976 | Easton | |
| 4,524,541 | A | 6/1985 | Geiges, Jr. | |
| D291,255 | S | 8/1987 | Levine | |
| 5,210,525 | A | 5/1993 | Lennon et al. | |
| 5,508,901 | A | 4/1996 | Kuo | |
| D397,575 | S | 9/1998 | Miller | |
| D412,276 | S | 7/1999 | Arslanian | |
| 6,341,874 | B1 | 1/2002 | Rubin | |
| 6,364,501 | B1 | 4/2002 | Tai | |
| 6,416,198 | B1 | 7/2002 | Vanderschuit | |
| 6,502,953 | B2 | 1/2003 | Hajianpour | |
| 6,669,352 | B2 | 12/2003 | McKinney | |
| 6,776,502 | B2 | 8/2004 | Hung | |
| 6,824,289 | B2 | 11/2004 | Vanderschuit | |
| D499,526 | S | 12/2004 | Albritton et al. | |
| 6,948,841 | B2 | 9/2005 | Tsai | |
| 7,244,038 | B2 | 7/2007 | Fotherby | |
| D569,301 | S | 5/2008 | Fotherby | |
| 2005/0141214 | A1 * | 6/2005 | Fotherby | 362/122 |
| 2007/0153523 | A1 | 7/2007 | Thornhill et al. | |

* cited by examiner

*Primary Examiner* — David V Bruce

(74) *Attorney, Agent, or Firm* — The Belles Group, P.C.

(57) ABSTRACT

A floating device that is capable of illumination. In one embodiment, the invention can be a floating illumination device comprising: a housing having a sealed interior cavity and a substantially vertical axis; a power source located within the sealed interior cavity, the power source comprising a first battery and a second battery separated by a gap; and a light source located within the sealed interior cavity and operably coupled to the power source, the light source located within the gap between the first battery and the second battery.

21 Claims, 6 Drawing Sheets

FLOATING ILLUMINATION DEVICE

FIELD OF THE INVENTION

The present invention relates generally to a floatable device that is capable of illumination, and more particularly to a floatable device having an optimized arrangement of the light source and the one or more batteries.

BACKGROUND OF THE INVENTION

Decorative ornaments have been placed in the water of an aquarium, a pool, a pond, a glass, a howl or a bath to provide a decorative effect and to enhance the aesthetic quality of the water. Furthermore, it is known to create such decorative ornaments so that the ornament generates light when placed in a liquid to increase the decorative appearance for entertaining, providing light, or for general enjoyment. However, conventional decorative ornaments of this type suffer from various drawbacks with regard to the positioning of the power source and light source within the ornament.

BRIEF SUMMARY OF THE INVENTION

The present invention is directed to a floating illumination device having a decorative housing and an end cap removably coupled to the decorative housing. The device, includes a power source and a light source, and a switch for controlling illumination of the light source.

In one embodiment, the invention can be a floating illumination device comprising: a housing having a sealed interior cavity and a substantially vertical axis; a power source located within the sealed interior cavity, the power source comprising a first battery and a second battery separated by a gap; and a light source located within the sealed interior cavity and operably coupled to the power source, the light source located within the gap between the first battery and the second battery.

In another embodiment, the invention can be a floating illumination device comprising: a housing comprising: a sealed interior cavity and a substantially vertical axis; a light source located within the sealed interior cavity so that no portion of the light source is located above a substantially horizontal reference plane; and a power source located within the sealed interior cavity adjacent the light source, the power source operably coupled to the light source and located so that at least a portion of the power source is above the substantially horizontal reference plane.

In yet another embodiment, the invention can be a floating illumination device comprising: A floating illumination device comprising: a housing comprising a decorative portion, an end cap, a sealed interior cavity, and a substantially vertical axis; a divider located within the sealed interior cavity to divide the sealed interior cavity into an inner chamber and an outer chamber that circumferentially surrounds the inner chamber; an end cap detachably coupled to the divider; and a light source and a power source mounted to the end cap, the light source and power source located within the inner chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
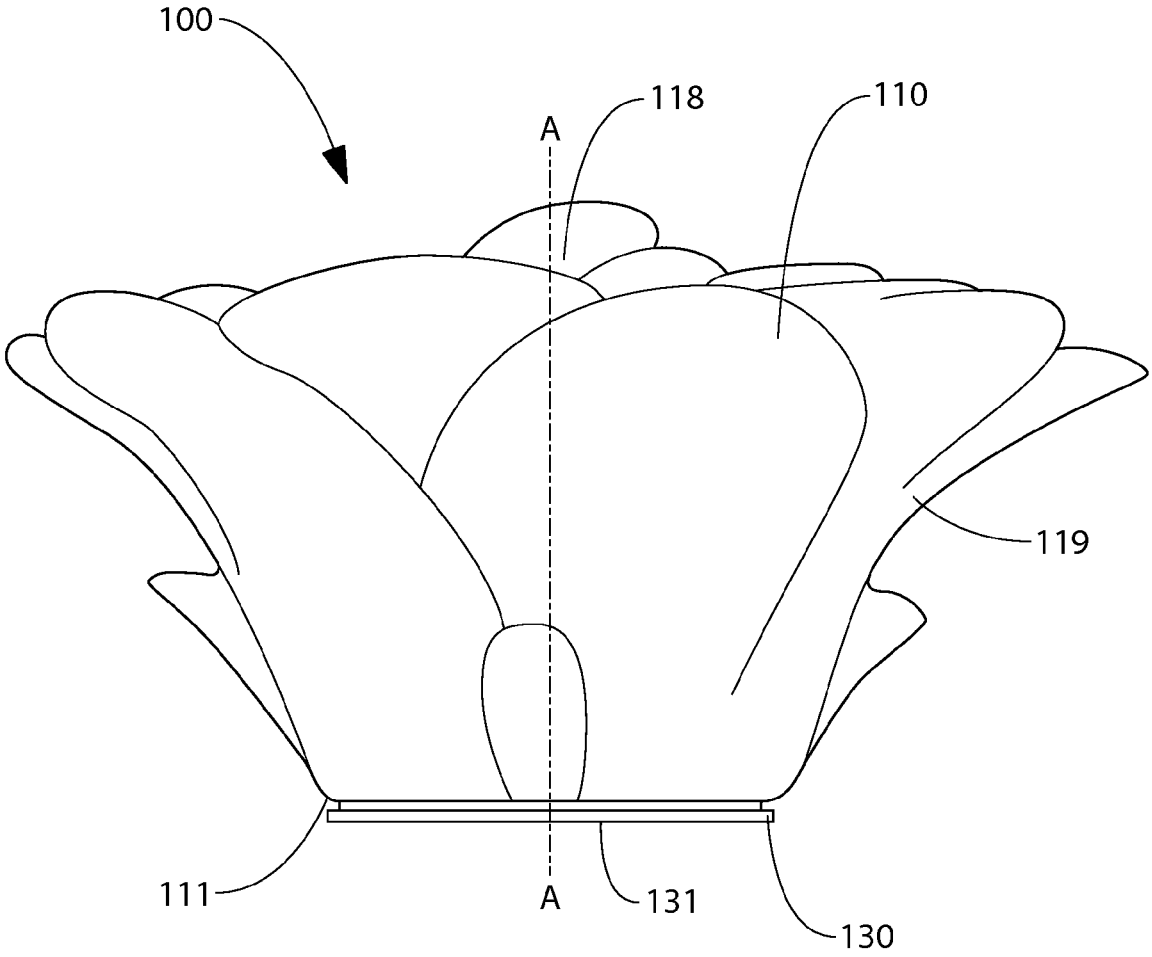
FIG. 1 is a front view of a floating illumination device in acct lance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Figure 2:
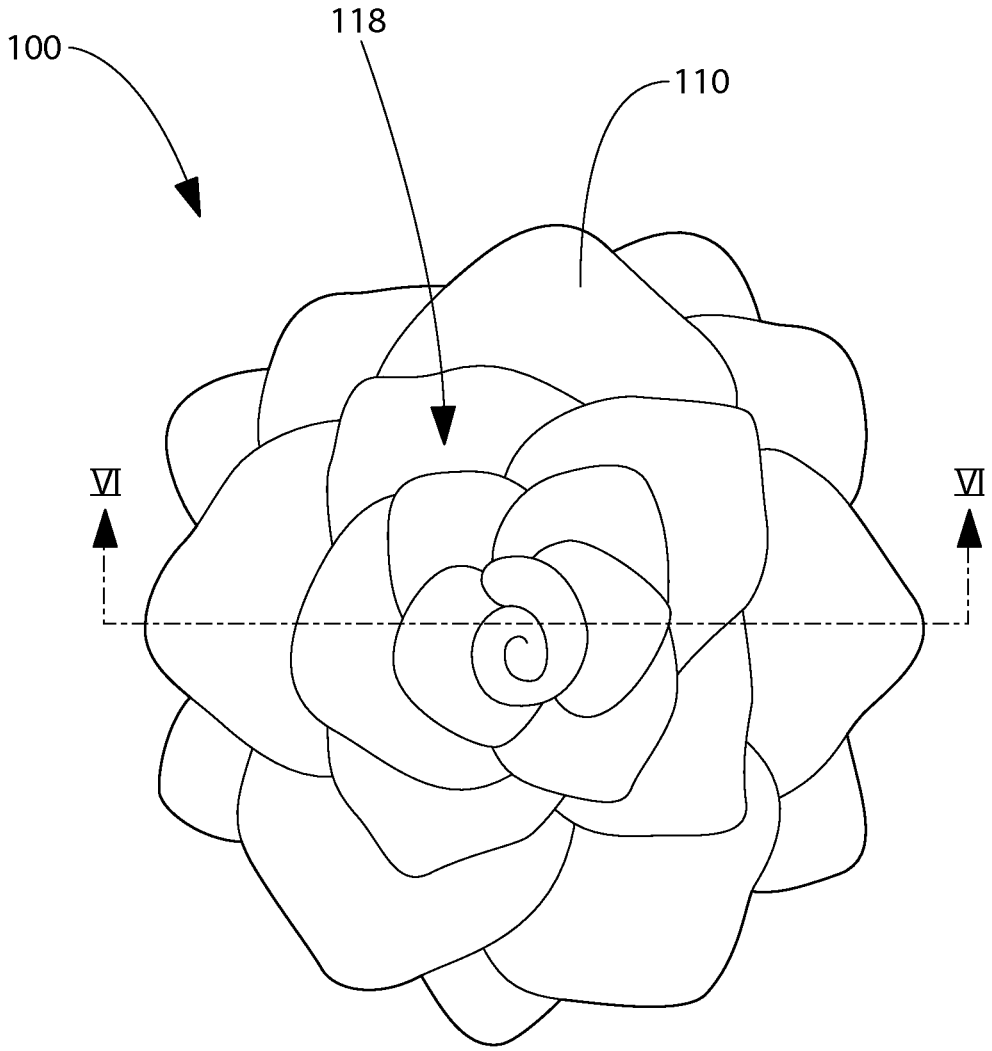
FIG. 2 is a top view of the floating, illumination device of FIG. 1.
Figure 3:
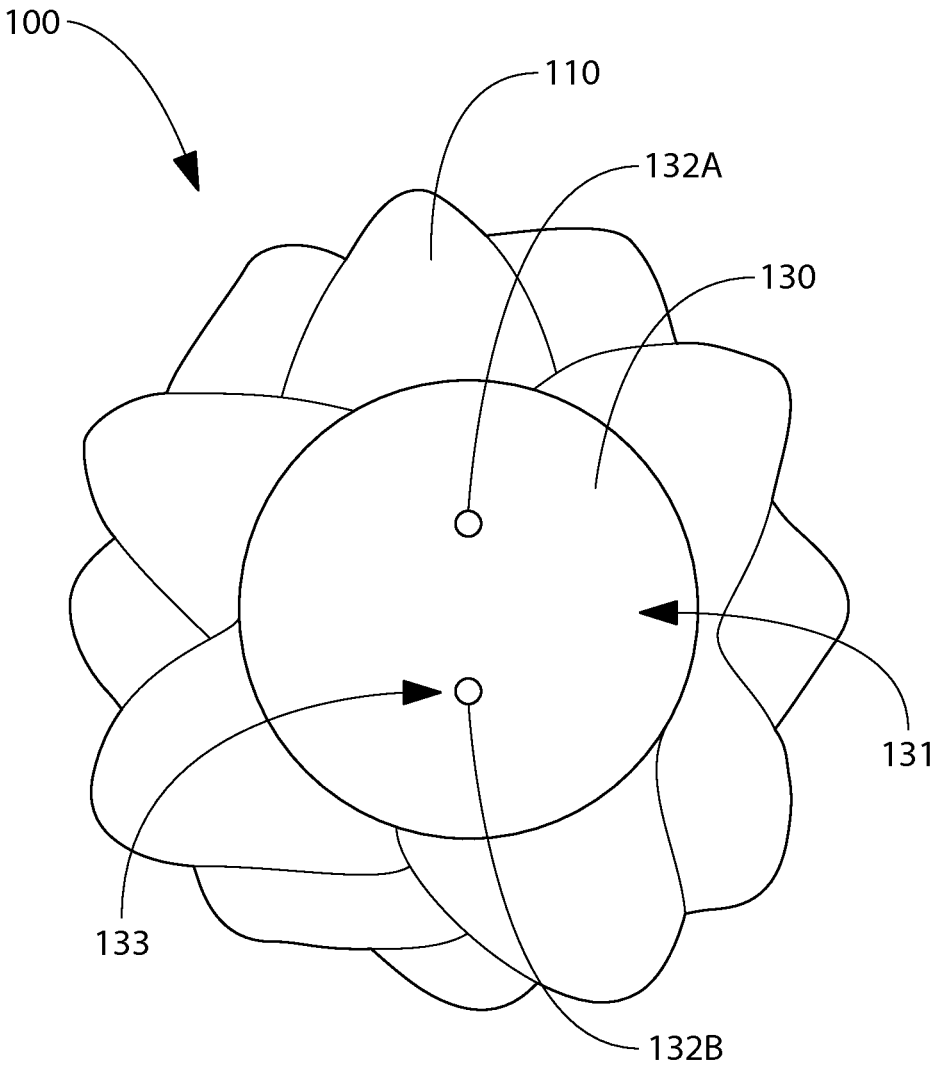
FIG. 3 is a bottom view of the floating illumination device of FIG. 1.

Referring first to FIGS. 1-3 concurrently, a floating illumination device 100 is illustrated in accordance with an embodiment of the present invention. In the exemplified embodiment, the floating illumination device 100 is in the shape of a flower. However, the invention is not to be so limited and the floating illumination device 100 can take on any shape to create a desired aesthetic effect. For example, in the exemplified embodiment the flower is a rose, but any other flower may be used such as a lily, a daisy, a hydrangea, a gardenia or the like. Furthermore, the floating illumination device 100 may alternatively take on the shape of an animal, an artistic and abstract form, a vehicle, a house or the like. Other shapes that the floating illumination device 100 may take include basic three-dimensional shapes such as cube, pyramid, cone, triangular prism, cylinder, sphere and the like. Thus, the exact shape of the floating illumination device 100 is not to be limiting of the invention in all embodiments unless so specified in the claims.

The floating illumination device 100 generally comprises a housing 110 that comprises a decorative portion 119 and an end cap 130. The housing 110 has a substantially vertical axis A-A. Tale decorative portion 119 of the housing 110 is the portion of the floating illumination device 100 that takes on the decorative shape, such as the shape of a rose in the exemplified embodiment. The end cap 130 is removably coupled to the decorative portion 119 (either directly or indirectly, as discussed in more detail below) such as by threaded engagement, snap fit, interference fit, metal tabs or the like. The coupling of the end cap 130 to the decorative portion 119 will be discussed in more detail below with reference to FIG. 6.

The decorative portion 119 of the housing 110 is formed of a material having a first hardness. In certain embodiments, the material that forms the decorative portion 119 of the housing 110 is a generally flexible material, such as a thermoplastic including but not limited to high-density polyethylene, polyvinyl chloride, or thermoplastic elastomer. Furthermore, in certain embodiments the decorative portion 119 of the housing 110 is formed of a floatable material so that the floating illumination device 100 can float when placed in a body of water such as a bath, a lake, a stream, a pool, a glass, a pond, an aquarium or the like. However, the decorative portion 119 of the housing 110 is not formed of a floatable material in all embodiments. Rather, in other embodiments the floating illumination device 100 may be a buoyant structure regardless of the material of the housing 110. As used herein, the term flexible means that the decorative portion 119 of the housing 110 is capable of bending or moving, but will bias back into its original shape after such flexing. As will be understood from the description below, the decorative portion of the housing 110 is formed of a material that is less rigid or hard than the material that forms the end cap 130 and certain other portions of the floating illumination device 100 discussed below.

In certain embodiments, the housing 110 can be formed of a light transmissive material so that a light source 140 (FIG. 4) located within the housing 110 can illuminate light through the housing 110. In certain embodiments, the light transmissive material may be created by forming the housing 110 (or at least the decorative portion 119 of the housing 110) of a transparent material. However, in other embodiments the housing 110 can be formed of a translucent material. When formed of a translucent material, the housing 110 can take on any color in the color spectrum so long as it has translucent qualities so that light can illuminate through the housing 110 to achieve a desired aesthetic effect. Furthermore, the thickness of the material that forms the housing 100 affects the light transmissivity of the housing 100, and it is merely desirable that all characteristics of the housing 110 including color and thickness facilitate the illumination of light through the housing 110.

The decorative portion 119 of the housing 110 has a bottom edge 111 and the end cap 130 has a bottom surface 131 in the exemplified embodiment, a switch 133 for controlling illumination of the light source 140 (FIG. 4) is located on the bottom surface 131 of the end cap 130. However, the invention is not to be so limited and in alternate embodiments the switch 133 can be positioned at other locations on the floating illumination device 100, such as, for example without limitation, directly on the decorative portion 119 of the housing 110.

In the exemplified embodiment the switch 133 comprises a pair of electrical contacts 132A, 132B. The pair of electrical contacts 132A, 132B is exposed on the bottom surface 131 of the end cap 130. The switch 133 can be closed by exposing each of the first and second electrical contacts 132A, 132B to an electrically conductive material so that the electrically conductive material extends between the first electrical contact 132A and the second electrical contact 132B. The electrically conductive material can be a conductive metal or a liquid, such as water. Of course, it should be appreciated that distilled or deionized water may not contain sufficient electrolytes to pass current, but that municipal water, well water, pond water, pool water and bath water contains sufficient dissolved, minerals or electrolytes to ensure electrical contact between the pair of electrical contacts 132A, 132B. Thus, as will be discussed in detail below, if both of the electrical contacts 132A, 132B are submerged in water, the switch 133 will be closed so that illumination of the light source 140 (FIG. 4) can be achieved. Of course, the invention is not to be limited to a switch such as described above, and in other embodiments the switch can be a mechanical switch such as a slide actuated switch, a button actuated switch or the like. Furthermore, in certain other embodiments the switch 133 can be omitted altogether.

Figure 4:
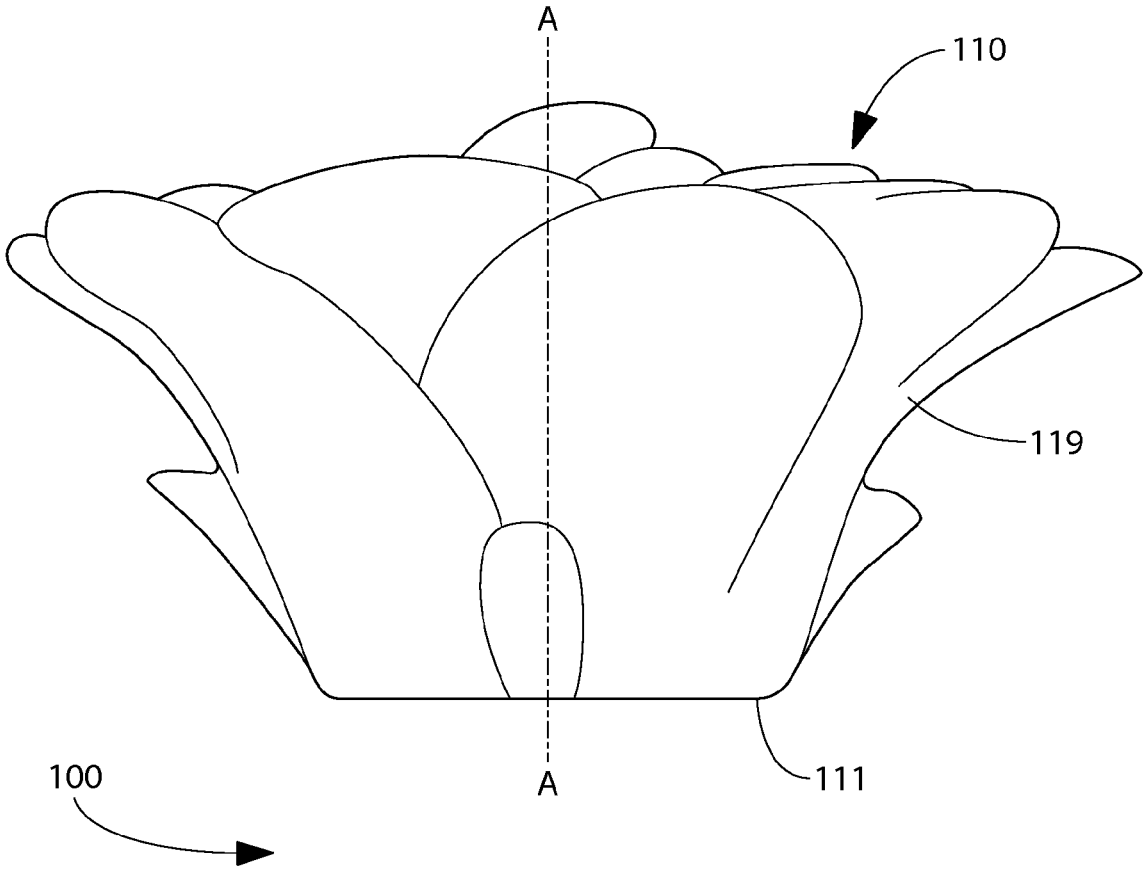
FIG. 4 is an exploded view of the floating illumination device of FIG. 1 illustrating a decorative housing separated from an end cap.
Figure 4:
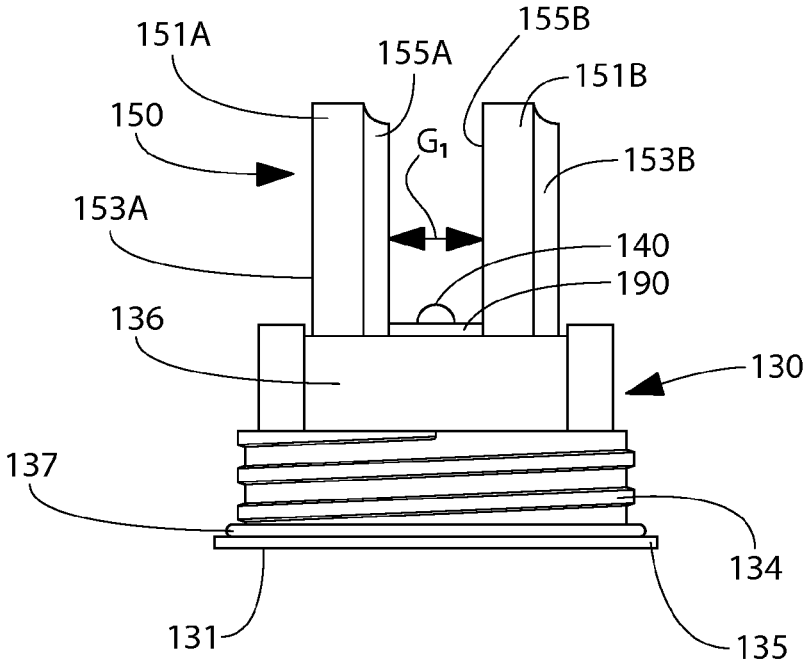

Referring to FIG. 4, the floating illumination device 100 is illustrated with the end cap 130 separated from the housing 110. The end cap 130 generally comprises a base 135 and a threaded wall 134 extending upward from the base 135. The threaded wall 134 is a cylindrically shaped wall having threads thereon for operable coupling of the end cap 130 to the decorative portion 119 of the housing 110. Of course, in other embodiments the threads of the threaded wall 134 can be omitted and the end cap 130 can be secured to the decorative portion 119 by other means such as those described above. The coupling of the end cap 130 to the decorative portion 119 can be achieved by direct connection or by an indirect connection (such as via coupling of the end cap 130 to a divider 180 as will be discussed in more detail below with reference to FIG. 6). The threaded wall 134 circumferentially surrounds an upstanding wall 136. In the exemplified embodiment, the upstanding wall 136 is rectangular in shape. However, the invention is not to be so limited in all embodiments and the upstanding wall 136 can take on any other shape. The upstanding wall 136 extends in an upward direction away from the base 135 a distance that is greater than a distance that the threaded wall 134 extends upwardly away from the base 135.

At the junction between the base 135 of the end cap 130 and the threaded wall 134 of the end cap 130, a gasket 137 is provided. In the exemplified embodiment, the gasket 137 circumferentially surrounds the threaded wall 134 at its bottom-most portion. The gasket 137 is formed of a resilient material such as rubber and provides a water tight seal between the end cap 130 and the decorative portion 119 of the housing 110 when the end cap 130 is coupled to the decorative portion 119 of the housing 110. More specifically, the gasket 137 facilitates preventing water and other liquids or debris from entering into an interior cavity of the housing 110 by being compressed between the bottom edge 111 of the decorative portion 119 and the base 135 of the end cap 130 when the end cap 130 is coupled to the decorative portion 119 of the housing 110.

Figure 5A:
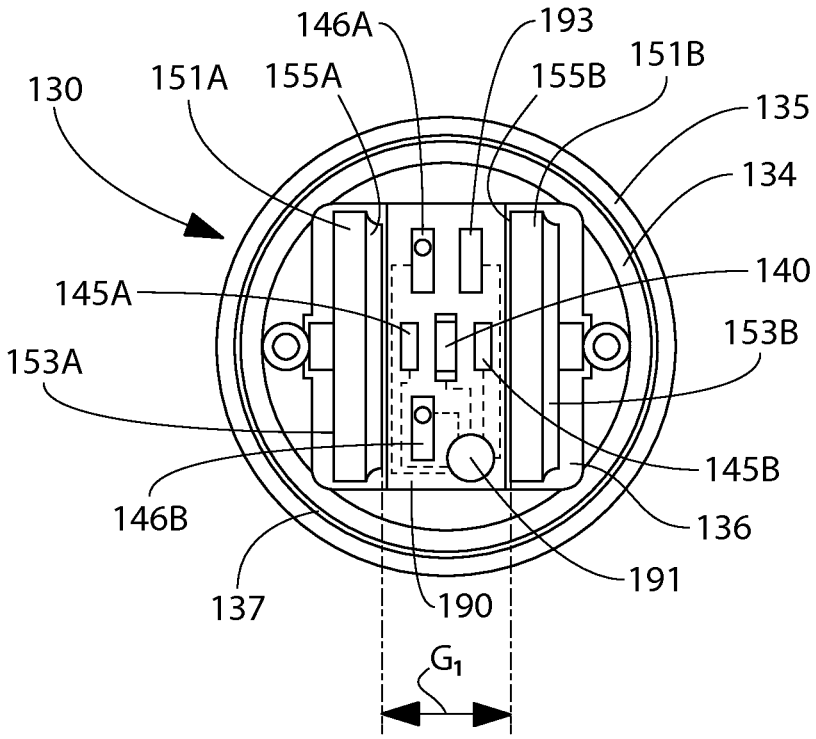
FIG. 5A is top view of the end cap of FIG. 5.
Figure 5B:
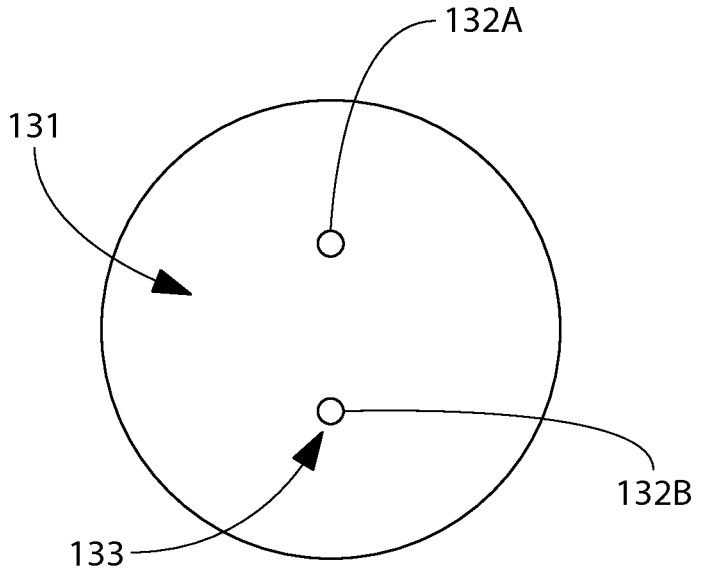
FIG. 5B is a bottom view of the end cap of FIG. 5.

Referring now to FIGS. 4, 5A and 5B concurrently, the end cap 130 and the other components that are positioned therein or coupled thereto will be further described. A power source 150 is removably mounted to the end cap 130. In the exemplified embodiment, the power source 150 comprises a first battery 151A and a second battery 151B. However, the invention is not to be so limited in all embodiments and in certain other embodiments the power source 150 may include only a single battery, more than two batteries, or a solar power unit or other type of power source.

A circuit board 190 is also mounted to the end cap 130. The circuit board 190 comprises the light source 140, battery contacts 145A, 145B, soldered ends 146A, 146B of the electrical contacts 132A, 132B (i.e., the switch 133) and a resistor 193 in operable connection so that when the switch 133 is closed by electrically coupling the first and second electrical contacts 132A 132B together as discussed above, the light source 140 is illuminated. The exact size of the resistor 193 can be selected as desired to achieve a particular brightness of the light source 140 and energy consumption rate of the power source 150. Furthermore, in certain embodiments the resistor 193 may be omitted. Each of the light source, the battery contacts 145A, 145B, the resistor 193 and the soldered ends 146A, 146B of the electrical contacts 132A, 132B are operably coupled together, either directly or indirectly via a hub 191 (as illustrated) so that when the switch is closed such as by water connecting the electrical contact 132A to the electrical contact 132B, the light source 140 illuminates. Although the exemplified embodiment illustrates the components connecting through the huh 191, in certain other embodiments the huh 191 can be omitted and the various components can be directly electrically coupled to one another.

In the exemplified embodiment, the light source 140 is a light emitting diode. However, the invention is not to be so limited in all embodiments and the light source 140 can be a light bulb or any other type of light, source as desired in other embodiments. Furthermore, the light source 140 may be selected to illuminate light in any color as desired. Thus, the circuit board 190 may include a processor for changing the color of light, that is illuminated by the light source 140, or for changing the manner in which the light is illuminated, such as solid light, blinking light or the like. Thus, the light source 140 may illuminate white light, red light, green light, blue light or the like. In certain embodiments, the color of light that is illuminated by the light source 140 is the same as the color of the housing 110. In still other embodiments the color of light that is illuminated by the light source 140 is a white light, but the light will appear to take on the color of the decorative portion 119 of the housing 110 as the light transmits through the decorative portion 119 of the housing 110. However, the invention is not to be limited by the color of light that is illuminated by the light source 140 in all embodiments unless so specified in the claims.

In the exemplified embodiment, the first battery 151A is spaced from the second battery 151B by a gap $G_1$. Furthermore, in the exemplified embodiment the circuit board 190 is attached to the end cap 130 along the gap $G_1$. Thus, the light source 140 is affixed to the circuit board 190 and is thereby positioned in between the first battery 151A and the second battery 152B. More specifically, in the exemplified embodiment the light source 140 is positioned in between the first battery 151A and the second battery 151B on both the horizontal and vertical perspectives.

In the exemplified embodiment, the first battery 151A has at least one reflective surface 155A and the second battery 151B has at least one reflective surface 155B. For example, the reflective surfaces 155A, 155B of the first and second batteries 151A, 151B may be metallic (i.e., silver, aluminum) or mirrored surfaces in certain embodiments, although the invention is not to be so limited in all embodiments. The reflective surfaces 155A, 155B of each of the first and second batteries 151A, 151B are adjacent to and facing the circuit board 190 and the light source 140. Thus, when the light source 140 is illuminated by closing the switch 133, the light from the light source 140 is reflected off of the reflective surfaces 155A, 155B of the first and second batteries 151A, 151B to enhance and/or alter the perceived illumination of the floating illumination device 100. The invention is not to be so limited, and in certain embodiments, the first and/or second batteries 151A, 151B may not include the reflective surfaces described above. Furthermore, in still other embodiments each of the first and second batteries 151A, 151B may have more than one reflective surface.

Figure 6:
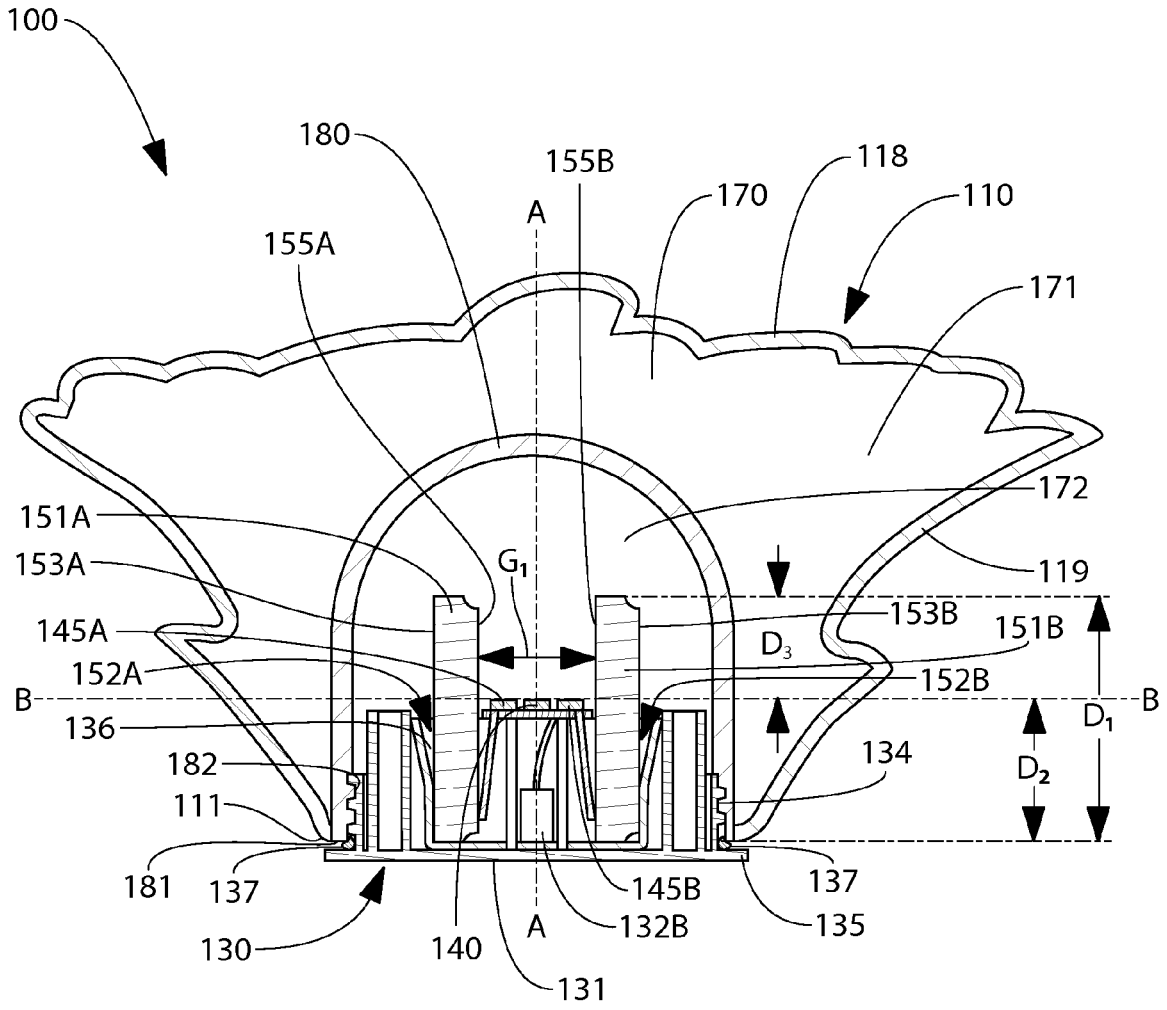
FIG. 6 is a cross-sectional view taken along line VII-VII of FIG. 2.

Referring to FIGS. 4 and 6 concurrently, the first battery 151A has a major surface 153A and the second battery 151B has a major surface 153B. In the exemplified embodiment, the major surfaces 153A, 153B of each of the first and second batteries 151A, 151B is oriented non-parallel to a horizontal reference plane B-B. More specifically, the major surfaces 153A, 153B of each of the first and second batteries 151A, 151B is oriented perpendicular (i.e., at a normal angle) to the horizontal reference plane B-B. However, the invention is not to be so limited in all embodiments, in certain other embodiments, the major surfaces 153A, 153B of each of the first and second batteries 151A, 151B may be oriented at a substantially non-normal angle to the horizontal reference plane B-B such that the major surfaces 153A, 153B are angled relative to the horizontal reference plane B-B. This substantially non-normal orientation may include both the structural arrangement wherein the batteries 151A, 151B converge towards each other as they extend from the bottom surface 131 of the end cap 130, or the structural arrangement wherein the batteries 151A, 151B diverge away from each other as they extend from the bottom surface 131 of the end cap 130. In certain embodiments, the major surfaces 153A, 153B of the first and second batteries 151A, 151B can be reflective.

Thus, depending upon whether the major surfaces 153A, 153B of the first and second batteries 151A, 151B are perpendicular or angled relative to the horizontal reference plane 13-B, the reflection of the light illuminating, from the light source towards the reflective surfaces 155A, 155B of the first and second batteries 151A, 151B will change. Specifically, if the major surfaces 153A, 153B of the first and second batteries 151A, 151B are angled so as to converge from the bottom surface 131 of the end cap 130, the light will reflect in a different pattern and with a different intensity than if the major surfaces 153A, 153B of the first and second batteries 151A, 151B are angled so as to diverge from the bottom surface 131 of the end cap 130, or if they are perpendicular to the bottom surface 131 of the end cap 130. In certain embodiments, the first and second batteries 151A, 151B may not be reflective, but used to merely block light and control the light emission angle. For example, in certain embodiments the location of the first and second batteries 151A, 151B relative to the light source 140 prevents light from illuminating through the sides of the decorative portion 119 of the housing 110, but instead causes a substantial entirety of the light to illuminate through the top of the decorative portion 119 of the housing 110. This technical feature helps to hide the bottom and sides of the decorative portion 119 of the housing 110 from view, particularly when the floating illumination device 100 is placed in water and used during the nighttime.

Referring to FIG. 6, the upstanding wall 136 of the end cap 130 has a first socket 152A sized and configured to retain the first battery 151A therein, and a second socket 152B sized and configured to retain the second battery 151B therein. More specifically, the first battery 151A is slidably mounted within the first socket 152A and the second battery 151B is slidably mounted within the second socket 152B. The first and second sockets 152A, 152B are separated from one another by the gap $G_1$. In the exemplified embodiment, each of the first and second batteries 151A, 151B is a generally flat, round, disk-shaped battery, such as a button cell battery. More specifically, in the exemplified embodiment each of the first and second batteries 151A, 151B are button batteries that are mounted in a sealed interior cavity 170 of the housing 110 in a substantially vertical orientation. Of course, the invention is not to be so limited in all embodiments and other battery types may be used.

The housing 110 has an interior cavity 170. More specifically, the housing 110 has a sealed interior cavity 170. In certain embodiments, the interior cavity 170 is hermetically sealed such that water or other liquids can not enter into the interior cavity 170 when the floating illumination device 100 is placed in water. The power source 150 and the light source 140 are located within the sealed interior cavity 170. Thus, the housing 110 is a hollowed-out structure that includes the interior cavity 170 within which the power source 150 and the light source 140 are positioned when the end cap 130 is removably coupled to the decorative portion 119 of the housing 110. More specifically, in the exemplified embodiment the power source 150 and the light source 140 are only located within the interior cavity 170 when the end cap 130 is coupled to the decorative portion 119 of the housing 119 because the power source 150 and the light source 140 are mounted on the end cap 130. However, the invention is not to be so limited in all embodiments and in certain other embodiments the housing 110 can be a sealed housing and the end cap 130 can be omitted such that the power source 150 and the light source 140 are permanently located within the sealed cavity 170. In such an embodiment, the power source 150 and the light source 140 can be placed within the sealed cavity 170 during manufacture of the floating illumination device 100.

As illustrated in FIG. 6 and discussed above, the housing 110 of the floating illumination device 100 is depicted with the substantially horizontal reference plane B-B. The light source 140 is located within the sealed interior cavity 170 so that no portion of the light source 140 is located above the substantially horizontal reference plane B-B. Furthermore, each of the first and second batteries 151A, 151B extends into the interior cavity 170 a distance $D_3$ above the substantially horizontal reference plane B-B. Thus, in embodiments wherein the batteries 151A, 151B have reflective surfaces 155A, 155B, the reflective surfaces 155A, 155B of the batteries 151A, 151B extend above the substantially horizontal reference plane B-B. This structural arrangement of the first and second batteries 151A, 151B relative to the light source 140 facilitates the reflection and/or blocking of the light illuminated from the light, source 140 as discussed above. In the exemplified embodiment, each of the first and second batteries 151A, 151B also has a portion that is located below the substantially horizontal reference plane B-B.

A divider 180 is coupled to the housing 110 and separates the interior cavity 170 of the housing 110 into an inner chamber 172 and an outer chamber 171. The divider 180 is formed of a material having a second hardness that is greater than the first hardness of the decorative portion 119 of the housing 110. In the exemplified embodiment, the divider 180 is a dome-shaped divider. However, the invention is not to be so limited in all embodiments and in certain other embodiments the divider can be otherwise shaped, such as U-shaped, triangular shaped, cone shaped or any other polygonal type shape. The outer chamber 171 circumferentially surrounds the inner chamber 172 about the substantially vertical axis A-A of the housing 110. The outer chamber 171 is a hollow cavity that contains no components therein. Thus, all of the electrical components of the floating illumination device, including the power source 150 (i.e., the first and second batteries 151A, 151B) and the light source 140, are entirely contained within the inner chamber 172.

In certain embodiments, the divider 180 can be used to reflect or direct the light illuminated from the light source 140. Furthermore, in some embodiments the divider 180 may include lenses of various shapes and sizes to facilitate the reflection or redirection of the light illuminated from the light source 140.

In the exemplified embodiment, the power source (i.e., the first and second batteries 151A, 151B) extends a first distance $D_1$ into the inner chamber 172 of the interior cavity 170 from the bottom end 111 of the decorative portion 119 of the housing 110 or from the bottom end 181 of the divider 180. Furthermore, the light source 140 is located at a second distance $D_2$ in the inner chamber 172 of the interior cavity 170 as measured from the bottom end 111 of the decorative portion 119 of the housing 110 or from the bottom end 181 of the divider 180. The first distance D1 is greater than the second distance D2. Thus, the first and second batteries 151A, 151B extend a greater distance into the inner chamber 172 than the light source 140. This structural feature of the floating illumination device 100 further facilitates reflection of the light from the light source 140 off of the reflective surfaces 155A, 155B of the first and second batteries 151A, 151B. Specifically, because the first and second batteries 151A, 151B extend further into the inner chamber 172 than the light source 140, the light from the light source 140 is certain to reflect off of the reflective surfaces 155A, 155B of the first and second batteries 151A, 151B during illumination thereof.

The divider 180 is formed of a rigid plastic material. More specifically, the material that forms the divider 180 is more rigid than the material that forms the decorative portion 119 of the housing 110. Of course, the invention is not to be so limited in all embodiments and in certain other embodiments the divider 180 and the housing 110 can be formed of the same material, or of different materials having similar rigidity. Furthermore, in the preferred embodiment the divider 180 is formed of a substantially transparent or clear material, although translucent or other light permeable materials can be used in alternative embodiments. Forming the divider 180 of a substantially transparent material is preferred to ensure that adequate light from the light source 140 is able to permeate through the housing 110 to provide the desired aesthetic effect.

The divider 180 is securely coupled to the housing 110 at the bottom end 111 of the decorative portion 119 of the housing 110 such that a bottom end 181 of the divider is substantially flush with the bottom end 111 of the housing 110. The divider 180 is securely coupled to the housing 110 by any means known in the art, such as adhesives, fasteners, tight fit, welding, melting, or the like. The divider 180 comprises threads 182 on its inner surface that correspond with the threads on the threaded wall 134 of the end cap 130. Thus, in the exemplified embodiment the end cap 130 is threadily coupled to the divider 180 when the floating illumination device 100 is assembled as illustrated in FIG. 6.

When the end cap 130 is removably coupled to the divider 180, and hence thereby removably coupled to the housing 110, the power source 150 (i.e., the first and second batteries 151A, 151B) and the light source 140 are entirely contained within the inner chamber 172 of the interior cavity 170. The gasket 137 comes into contact with the bottom edge 181 of the divider 180 to prevent the ingress of water or debris into the inner chamber 172. Thus, the power source 150 and the light source 140 are protected against water or debris damage when located within the inner chamber 172. Thus, in the exemplified embodiment the end cap 130 is indirectly coupled to the decorative portion 119 of the housing 110 via the divider 180 to seal the inner chamber 172. Furthermore, the divider 180 is secured to the decorative portion 119 of the housing 110 to seal the outer chamber 171. Thus, each of the inner and outer chambers 172, 171 of the housing 110 are sealed to prevent the ingress of water or other liquids into the inner and outer chambers 172, 171.

The floatable illumination device 100 can be placed in a water body and the floatable illumination device 100 will float thereon. When in water, the electrical contacts 132A, 132B of the switch 133 will be electrically connected to one another so as to close the switch 133 and form a closed-loop electrical/current path between the batteries 151A, 151B and the light source 140. In this manner, when the floatable illumination device 100 is placed in water, the light source 140 illuminates to provide a decorative, pleasant aesthetic.

Referring to FIGS. 1, 2 and 6 concurrently, the decorative portion 119 of the housing 110 has a top portion 118 that remains at or above a surface of a body of liquid when the floating illumination device 100 is positioned in the body of liquid. The top portion 118 of the decorative portion 119 of the housing 110 is located above the substantially horizontal reference plane B-B. In certain embodiments, the light illuminated from the light source 140 is directed by the batteries 151A, 151B to illuminate solely or mostly through the top portion 118 of the decorative portion 119 of the housing 110. In other words, light is preventing from illuminating through the side portions of the housing 110, which are covered by the water when the floating illumination device 100 is located in the water. This ensures that a greater amount of the light illuminated from the light source 140 is visible to a user.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A floating illumination device comprising:

a housing having a sealed interior cavity and a substantially vertical axis;

a power source located within the sealed interior cavity, the power source comprising a first battery and a second battery separated by a gap; and a light source located within the sealed interior cavity and operably coupled to the power source, the light source located within the gap between the first battery and the second battery.

2. The floating illumination device of claim 1 wherein each of the first and second batteries has a reflective surface facing the light source.

3. The floating illumination device of claim 1 wherein the light source is located within the sealed interior cavity so that no portion of the light source is located above a substantially horizontal reference plane, and each of the first and second batteries extends into the interior cavity a distance above the substantially horizontal reference plane.

4. The floating illumination device of claim 3 wherein each of the first and second batteries has a reflective surface facing the light source.

5. The floating illumination device of claim 3 wherein each of the first and second batteries has a major surface oriented non-parallel to the substantially horizontal reference plane.

6. The floating illumination device of claim 1 wherein the housing comprises a decorative portion and an end cap detachably coupled to the decorative portion, the light source and the power source mounted to the end cap, and a switch operably coupled to a circuit that includes the power source and the light source, the switch located on the end cap.

7. The floating illumination device of claim 1 further comprising a divider located within the sealed interior cavity to divide the sealed interior cavity into an inner chamber and an outer chamber, the power source and the light source located within the inner chamber.

8. The floating illumination device of claim 7 wherein the housing comprises an end cap and a decorative portion, the divider secured to the decorative portion to seal the outer chamber, the end cap detachably coupled to the decorative portion to seal the inner chamber, the light source and the power source mounted to the end cap.

9. The floating illumination device of claim 8 wherein the decorative portion is formed of a material having a first hardness and the divider is formed of a material having a second hardness, the second hardness greater than the first hardness.

10. The floating illumination device of claim 1 wherein the housing comprises a decorative portion and an end cap detachably coupled to the decorative portion, wherein the end cap comprises a first socket and a second socket, the first battery slidably mounted within the first socket and the second battery slidably mounted within the second socket, and wherein the light source is affixed to a printed circuit board that is mounted to the end cap between the first and second sockets.

11. The floating illumination device of claim 1 wherein the first and second batteries are button batteries mounted in the sealed interior cavity in a substantially vertical orientation.

12. A floating illumination device comprising:

a housing comprising a sealed interior cavity and a substantially vertical axis;

a light source located within the sealed interior cavity so that no portion of the light source is located above a substantially horizontal reference plane; and a power source located within the sealed interior cavity adjacent the light source, the power source operably coupled to the light source and located so that at least a portion of the power source is above the substantially horizontal reference plane.

13. The floating illumination device of claim 12 wherein the housing comprises a decorative portion having a top portion that remains at or above a surface of a body of liquid when the floating illumination device is positioned in the body of liquid, wherein the top portion of the decorative portion is located above the substantially horizontal reference plane.

14. The floating illumination device of claim 13 wherein the power source comprises a reflective surface facing the light source that extends above the substantially horizontal reference plane.

15. The floating illumination device of claim 13 wherein the power source is at least one battery having a major surface that is oriented non-parallel to the substantially horizontal reference plane.

16. The floating illumination device of claim 15 wherein the major surface of the battery is oriented at a substantially non-normal angle relative to the substantially horizontal reference plane.

17. The floating illumination device of claim 16 wherein a portion of the power source is located below the substantially horizontal reference plane.

18. The floating illumination device of claim 12 wherein the housing comprises a decorative portion and an end cap detachably coupled to the decorative portion, the light source and the power source mounted to the end cap, and a switch operably coupled to a circuit that includes the power source and the light source, the switch located on the end cap.

19. The floating illumination device of claim 12 further comprising a divider located within the sealed interior cavity to divide the sealed interior cavity into an inner chamber and an outer chamber that circumferentially surrounds the inner chamber, the power source and the light source located within the inner chamber.

20. The floating illumination device of claim 19 wherein the housing comprises a decorative portion and an end cap, wherein the divider has a bottom edge that is substantially flush with a bottom edge of the decorative portion, the end cap detachably coupled to the divider via threaded engagement, and wherein the power source and lights source are mounted to the end cap.

21. A floating illumination device comprising:

a housing comprising a decorative portion, an end cap, a sealed interior cavity, and a substantially vertical axis;

a divider located within the sealed interior cavity to divide the sealed interior cavity into an inner chamber and an outer chamber that circumferentially surrounds the inner chamber;

an end cap detachably coupled to the divider; and a light source and a power source mounted to the end cap, the light source and power source located within the inner chamber.

* * * * *